United States Patent [19]

Serizawa et al.

[11] Patent Number: 4,945,453

[45] Date of Patent: Jul. 31, 1990

[54] VEHICULAR HEADLAMP

[75] Inventors: Hiroyuki Serizawa; Akio Mochizuki, both of Shizuoka, Japan

[73] Assignee: Koito Manufacturing Co., Ltd., Tokyo, Japan

[21] Appl. No.: 392,518

[22] Filed: Aug. 11, 1989

[30] Foreign Application Priority Data

Aug. 16, 1988 [JP] Japan ..... 63-203561

[51] Int. Cl.[5] ..... F21M 3/30

[52] U.S. Cl. ..... 362/61; 362/211; 362/214; 313/115

[58] Field of Search ..... 313/115; 362/61, 211, 362/214, 215, 346, 347, 255, 256

[56] References Cited

U.S. PATENT DOCUMENTS

| | | | |
|---|---|---|---|
| 1,792,598 | 2/1931 | Michel | 362/211 |
| 2,074,626 | 3/1937 | Strange | 362/211 |
| 3,375,363 | 3/1968 | Rynders et al. | 362/211 |
| 4,225,903 | 9/1980 | Buchleitner | 362/214 X |
| 4,302,698 | 11/1981 | Kiesel et al. | 313/222 |
| 4,532,262 | 6/1985 | Shinkai | 362/61 X |
| 4,566,056 | 1/1986 | Kouchi et al. | 362/297 |
| 4,580,199 | 4/1986 | Wurster et al. | 362/211 |
| 4,612,608 | 9/1986 | Peitz | 362/297 |
| 4,682,072 | 7/1987 | Schihara et al. | 362/211 X |

FOREIGN PATENT DOCUMENTS

| | | | |
|---|---|---|---|
| 459831 | 9/1949 | Canada | 361/215 |

*Primary Examiner*—Ira S. Lazarus
*Assistant Examiner*—Peggy A. Neils
*Attorney, Agent, or Firm*—Browdy and Neimark

[57] ABSTRACT

Herein disclosed is a vehicular headlamp. The headlamp comprises a concave light reflector which includes upper and lower light reflecting surfaces each being of a paraboloid of revolution. The upper and lower light reflecting surfaces have respective upper and lower rotation axes which extend forward in parallel with each other and have respective focuses on the axes. The respective focuses are located at respective positions where an imaginary line perpendicular to the rotation axes intersects the same. A lens covers an opening of the concave light reflector. A first light source is positioned at the focus of the lower light reflecting surface, and a second light source is positioned just above the focus of the upper light reflecting surface.

9 Claims, 11 Drawing Sheets

VEHICULAR HEADLAMP

BACKGROUND OF THE INVENTION

1. Field of the Invention

The present invention relates in general to vehicular headlamps, and more particularly, to vehicular headlamps of a type which has respective light sources for high and low beams projected therefrom.

2. Description of the Prior Art

In order to clarify the task of the present invention, one conventional vehicular headlamp of the above-mentioned type will be described with reference to FIGS. 9 to 11 of the accompanying drawings.

The conventional headlamp is shown in FIGS. 9 and 10, which is generally designated by reference "a" and comprises a concave light reflector "b" which has a light reflecting surface "c" of paraboloid of revolution with a focus at the point "F". The light reflector "b" has an opening shaped generally rectangular.

Designated by reference "d" is a filament for a high beam, which is located below the focus "F" of the light reflecting surface "c" at a somewhat left side of the same, as viewed from the front of the headlamp "a". The filament "d" extends substantially horizontally in a direction perpendicular to a rotation axis "x-x" of the light reflecting surface "c". It is to be noted that the rotation axis is the imaginary axis about which a parabolic line is rotated for formation of the light reflecting surface "c".

Designated by reference "e" is a filament for a low beam, which is located above the focus "F" at a somewhat right side of the same, as viewed from the front of the headlamp "a". Similar to the filament "d" for the high beam, the filament "e" extends substantially horizontally in a direction perpendicular to the rotation axis "x-x" of the light reflecting surface "c".

A lens (not shown) is positioned in front of the concave light reflector "b".

When, in operation, the filament "d" for the high beam is energized and thus produces a light, the headlamp "a" projects a light beam which has such a contoured beam pattern "f" as shown in FIG. 11A.

It is to be noted that the pattern "f" is an illuminated image shown on a screen which is positioned in the front of the headlamp "a". The line "H-H" is the horizontal line which extends through a point corresponding to the center of the headlamp "a", and the line "V-V" is the vertical line which extends through the point.

While, when the filament "e" for the low beam is energized to produce a light, the headlamp "a" projects a light beam which has such a contoured beam pattern "g" as shown in FIG. 11B.

However, due to its inherent construction, the headlamp "a" has the following drawbacks.

Since, in the high beam pattern, the intersecting portion (pointed by the finger mark 1) of the horizontal and vertical lines "H-H" and "V-V" is positioned away considerably from the center of the high beam pattern "f", the illumination degree at the intersecting portion is lowered thereby making the long distance illuminating ability very poor. Furthermore, since the portion pointed by the finger mark 2 is supplied with substantially no light, the middle distance illuminating ability of the headlamp "a" is also poor.

Furthermore, since the low beam pattern "g" has no illuminated zone at the portion pointed by the finger mark 3, the neighbouring illuminating ability of the headlamp is poor.

SUMMARY OF THE INVENTION

It is therefore an object of the present invention to provide a vehicular headlamp which is free of the above-mentioned drawbacks.

According to the present invention, there is provided a vehicular headlamp which exhibits superiority in distance illuminating ability as well as neighbouring illuminating ability.

According to the present invention, there is provided a vehicular headlamp which comprises a concave light reflector including upper and lower light reflecting surfaces each being of a paraboloid of revolution, the upper and lower light reflecting surfaces having respective upper and lower rotation axes which extend forward in parallel with each other and having respective focuses on the axes, the respective focuses being located at respective positions where an imaginary line perpendicular to the rotation axes intersects the same; a lens positioned in front of the concave light reflector; a first light source positioned at the focus of the lower light reflecting surface; and a second light source positioned just above the focus of the upper light reflecting surface.

BRIEF DESCRIPTION OF THE DRAWINGS

Other objects and advantages of the present invention will become apparent from the following description when taken in conjunction with the accompanying drawings, in which:

FIGS. 1 to 4 are drawings showing a vehicular headlamp of a first embodiment of the present invention, in which, FIG. 1 is a partially broken perspective view of the headlamp;

FIG. 2 is a front view of the headlamp;

FIG. 3 is a vertically sectional, but schematic, view of the headlamp; and

FIGS. 5 to 8 are drawings showing a vehicular headlamp of a second embodiment of the present invention, in which, FIG. 5 is a partially broken perspective view of the headlamp;

FIG. 6 is a front view of the headlamp;

FIG. 7 is a vertically sectional, but schematic, view of the headlamp; and

FIGS. 9 to 11 are drawings showing a conventional headlamp, in which, FIG. 9 is a front view of the conventional headlamp;

FIG. 10 is a vertically sectional, but schematic, view of the conventional headlamp.

DETAILED DESCRIPTION ON OF THE INVENTION

Figure 1:
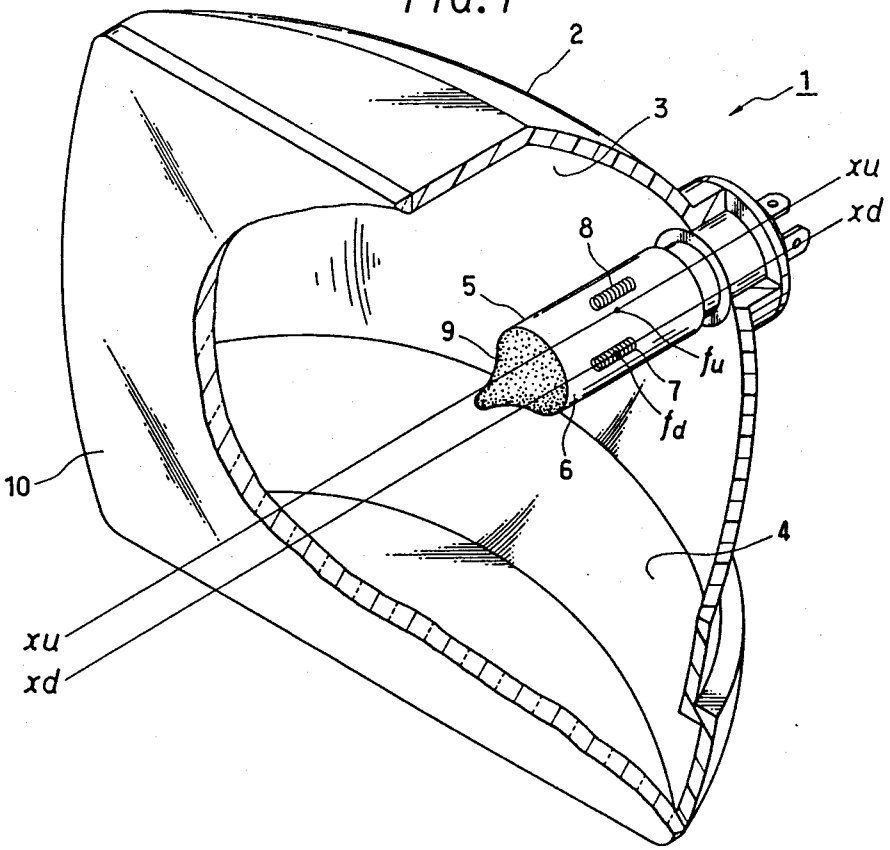
Figure 2:
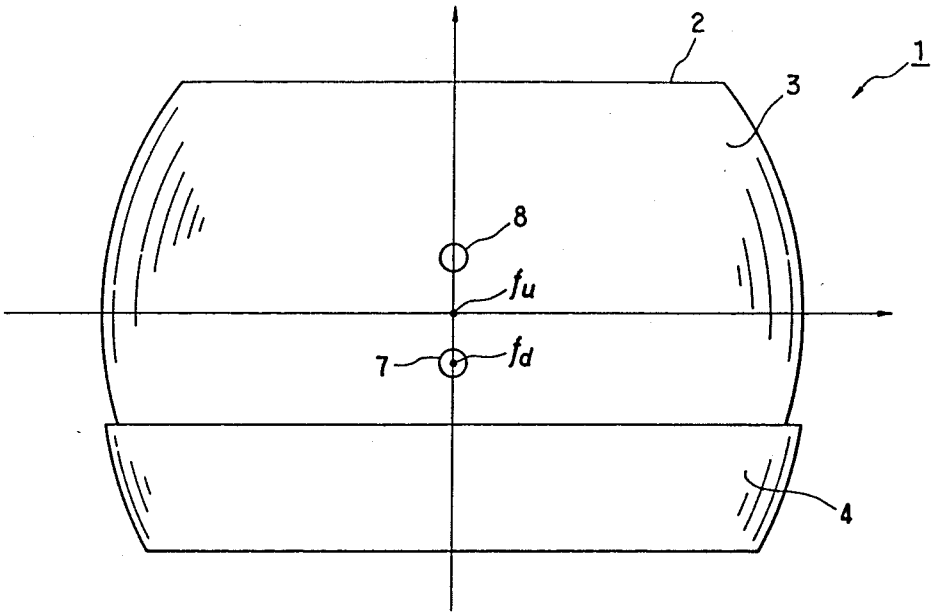
Figure 3:
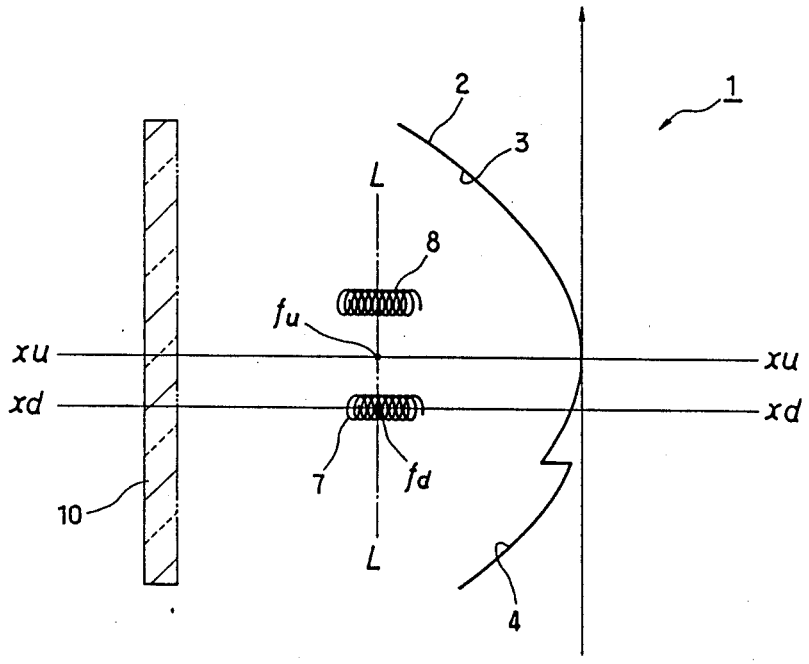

Referring to FIGS. 1 to 4, particularly FIG. 1, there is shown a vehicular headlamp of a first embodiment of the present invention, which is generally designated by numeral 1.

The headlamp 1 comprises a concave light reflector 2 whose opening is shaped generally rectangular. When the headlamp 1 is properly mounted on a motor vehicle, it is so oriented that the longer axis of the rectangular opening lies horizontally.

The concave light reflector 2 includes an upper concave light reflecting surface 3 and a lower concave light reflecting surface 4. As is seen from FIG. 2, the upper concave light reflecting surface 3 covers about two-thirds of the light reflecting surface area of the light reflector 2. In fact, it is preferable that the upper light reflecting surface occupies about 50 to 75 percent of the entire light reflecting area of the concave light reflector. Each light reflecting surface 3 or 4 has a shape of a paraboloid of revolution.

As is seen from FIG. 1, a rotation axis "xu-xu" of the upper light reflecting surface 3 extends in a fore-and-aft direction of the headlamp 1, while, a rotation axis "xd-xd" of the lower light reflecting surface 4 extends in parallel with the axis "xu-xu" just below the same. Respective focuses "fu" and "fd" of the upper and lower light reflecting surfaces 3 and 4 are located on the respective rotation axes "xu-xu" and "xd-xd"at respective positions where an imaginary line "L-L" perpendicular to the axes "xu-xu" and "xd-xd" intersects the same.

Designated by numeral 5 is an electric bulb which is held by the light reflector 2. The electric bulb 5 has two parallelly extending upper and lower coiled filaments 8 and 7 contained therein. As shown, each filament 7 or 8 extends in parallel with the axis of a glass tube 6 of the electric bulb 5. It is to be noted that the filaments 7 and 8 are for the high and low beams, respectively, which extend along the respective rotation axes "xu-xu" and "xd-xd" of the light reflecting surfaces 3 and 4.

As is seen from FIG. 1, the middle portion of the high beam filament 7 is placed on the focus "fd" of the lower light reflecting surface 4. While, the low beam filament 8 is placed just above the focus "fu" of the upper light reflecting surface 3.

The glass tube 6 of the electric bulb 5 has a tip portion coated with a light blocking material 9. With provision of the light blocking material 9, light rays projected forward directly from the filaments 7 and 8 are blocked. That is, only light rays which have been reflected by the light reflector 2 are permitted to project forward from the headlamp 1.

Designated by numeral 10 is a lens which is arranged in a manner to cover the opening of the light reflector 2.

Figure 4A:
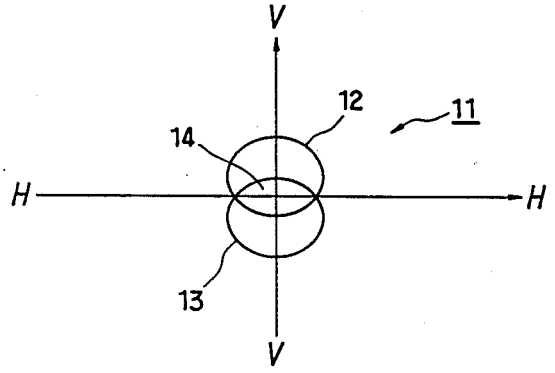
FIGS. 4A and 4B are respective illustrations of high and low beam patterns provided by the headlamp.

When, in operation, the filament 7 for the high beam is energized to produce a light, the headlamp 1 projects a light beam which has such a contoured beam pattern 11 as shown in FIG. 4A. It is to be noted that the upper illuminated part 12 is the part provided by light rays which have been reflected by the upper light reflecting surface 3, while, the lower illuminated part 13 is the part provided by light rays which have been reflected by the lower light reflecting surface 4.

As will be seen from FIG. 4A, since the upper and lower illuminated parts 12 and, 13 have, at the intersecting portion of the horizontal and vertical lines "H-H" and "V-V", respective portions 14 overlapped to each other, the illumination degree at the intersecting portion is increased thereby improving the long distance illuminating ability of the headlamp 1. Furthermore, since the lower illuminated part 13 provided by light rays from the lower light reflecting surface 4 has a considerable portion which extends downward from the horizontal line "H-H", the middle distance illuminating ability of the headlamp 1 is improved.

Figure 4B:
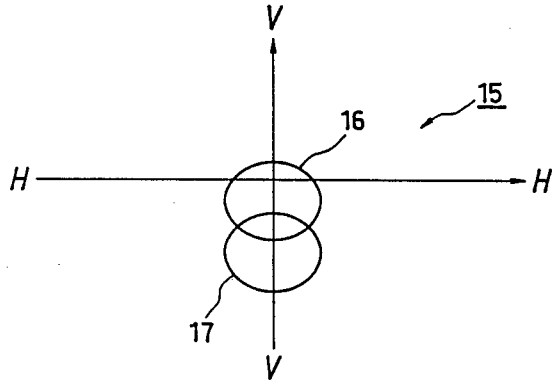

When the filament 8 for the low beam is energized to produce a light, the headlamp 1 projects a light beam which has such a contoured beam pattern 15 as shown in FIG. 4B. It is to be noted that the upper illuminated part 16 is the part provided by light rays which have been reflected by the upper light reflecting surface 3, while, the lower illuminated part 17 is the part provided by light rays which have been reflected by the lower light reflecting surface 4.

As will be understood from FIG. 4B, since the lower illuminated part 17 is placed below the horizontal line "H-H" at a considerable distance from the same, the neighbouring illuminating ability of the headlamp 1 is improved.

Figure 5:
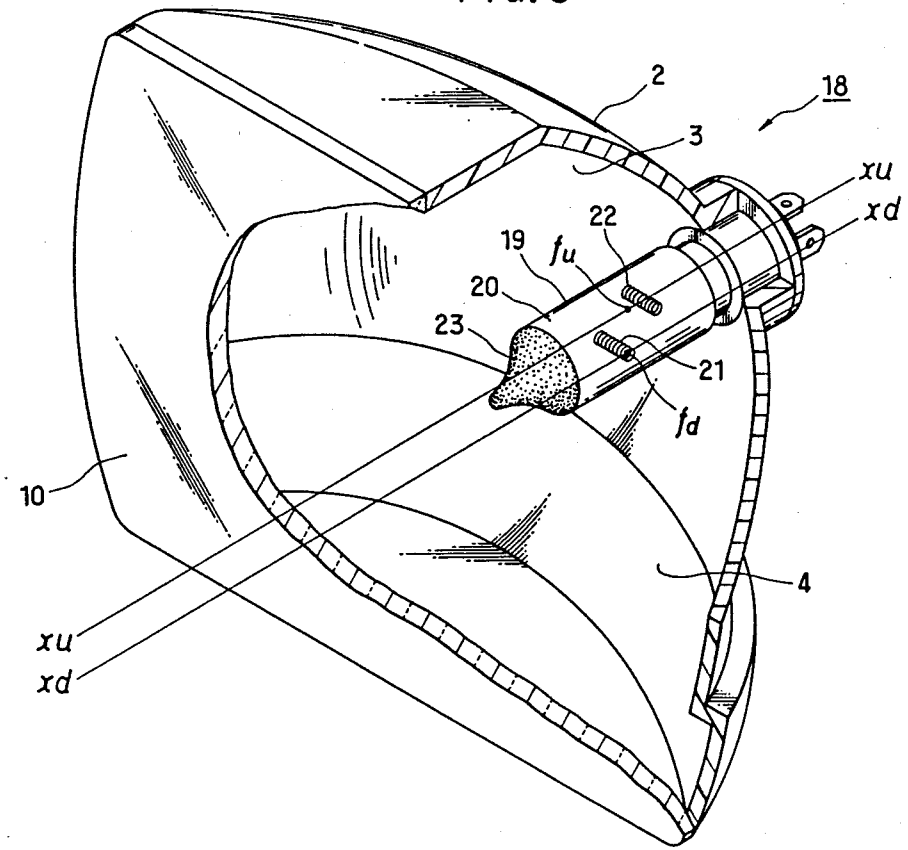

Referring to FIGS. 5 to 8, particularly FIG. 5, there is shown a vehicular headlamp of a second embodiment of the present invention, which is generally designated by numeral 18.

Since the headlamp 18 of this second embodiment is similar to that of the above-mentioned first embodiment 1, only portions and parts which are different from those of the first embodiment will be described in the following. The portions and parts similar or identical to those of the first embodiment 1 are denoted by the same numerals.

Designated by numeral 19 is an electric bulb which is held by the light reflector 2. The electric bulb 19 has two parallelly extending upper and lower coiled filaments 22 and 21 contained therein. It is to be noted that the filaments 21 and 22 are for the high and low beams, respectively. As shown, each filament 21 or 22 extends horizontally in a direction perpendicular to the axis of a glass tube 20 of the electric bulb 19. Designated by numeral 23 is a light blocking material applied to the tip portion of the glass tube 20.

Figure 6:
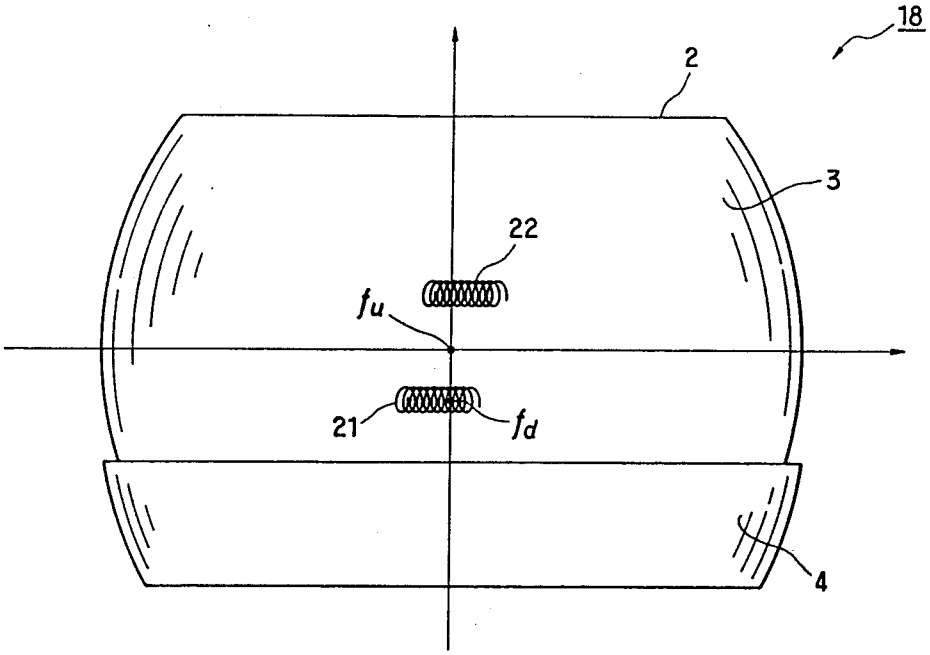
Figure 7:
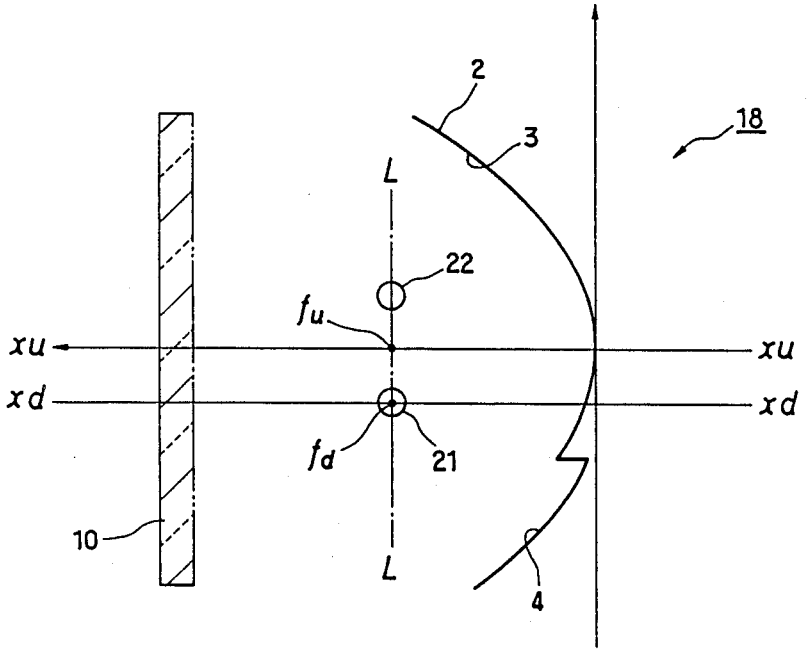

As will be understood from FIG. 6, the filament 21 and the other filaments 22 are arranged at positions which are somewhat offset with respect to an imaginary plane which contains both the rotation axes "xu-xu" and "xd-xd". That is, the high beam filament 21 is so arranged as to have its right portion (as viewed from the front of the headlamp 18) located on the focus "fd" of the lower light reflecting surface 4. Thus, the filament 21 extends perpendicular to the rotation axis "xd-xd" of the lower light reflecting surface 4. While, the low beam filament 22 is so arranged as to have its left portion (as viewed from the front of the headlamp 18) positioned just above the focus "fu" of the upper light reflecting surface 3. Thus, the low beam filament 22 extends in a direction perpendicular to the rotation axis "xu-xu" of the upper light reflecting surface 3.

It is to be noted that the description on the positional relationship between each filament 21 or 22 and the light reflector 2 is directed to a motor vehicle which usually runs on a left side of a road. Thus, if the motor vehicle is of a type which is compelled to run on a right side of a road, the abovementioned positional relationship should be reversed.

Figure 8A:
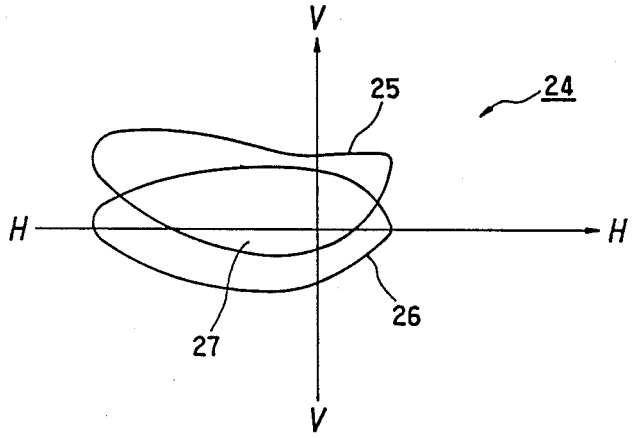
FIGS. 8A and 8B are respective illustrations of high and low beam patterns provided by the headlamp.

When, in operation, the filament 21 for the high beam is energized to produce a light, the headlamp 18 projects a light beam which has such a contoured beam pattern 24 as shown in FIG. 8A. It is to be noted that the upper illuminated part 25 is the part provided by light rays which have been reflected by the upper light reflecting surface 3, while, the lower illuminated part 26 is the part provided by light rays which have been reflected by the lower light reflecting surface 4.

As is seen from FIG. 8A, since the upper and lower illuminated parts 25 and 26 have, at the intersecting portion of the horizontal and vertical lines "H-H" and "V-V", respective portions overlapped, the illumination degree at the intersecting portion is increased thereby improving the long distance illuminating ability of the headlamp 18. Furthermore, since the lower illuminated part 26 provided by light rays from the lower light reflecting surface 4 has a portion which extends downward considerably from the horizontal line "H-H", the middle distance illuminating ability of the headlamp 18 is also improved.

Figure 8B:
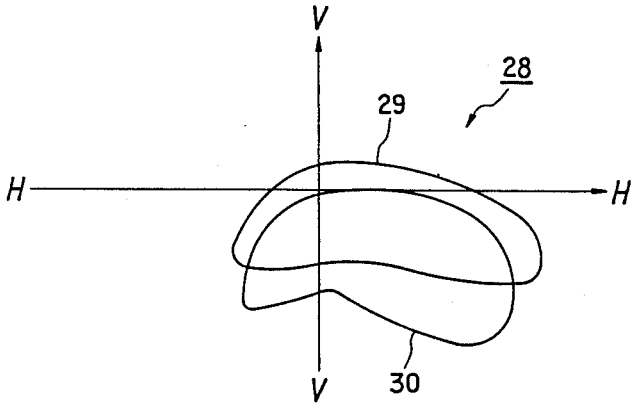
Figure 9:
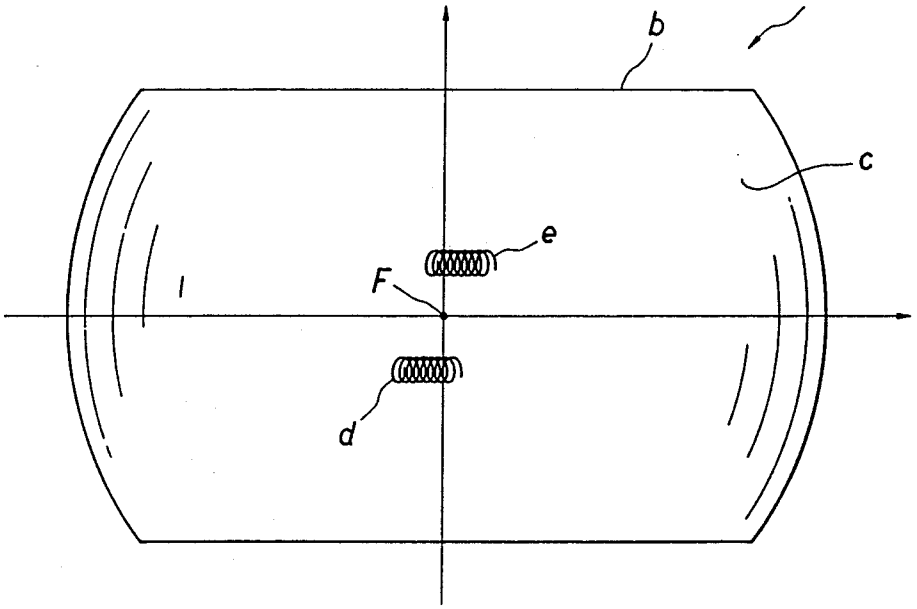
FIG. 9 PRIOR ART
Figure 10:
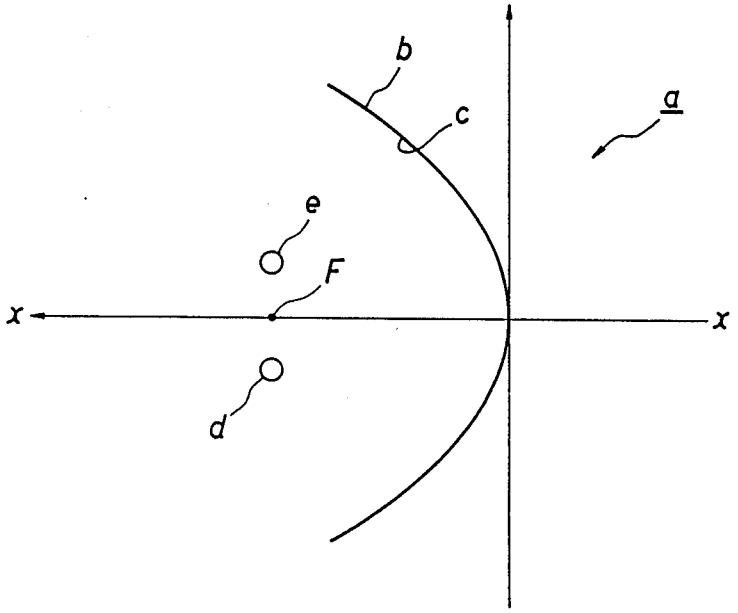
FIG. 10 PRIOR ART
Figure 11A:
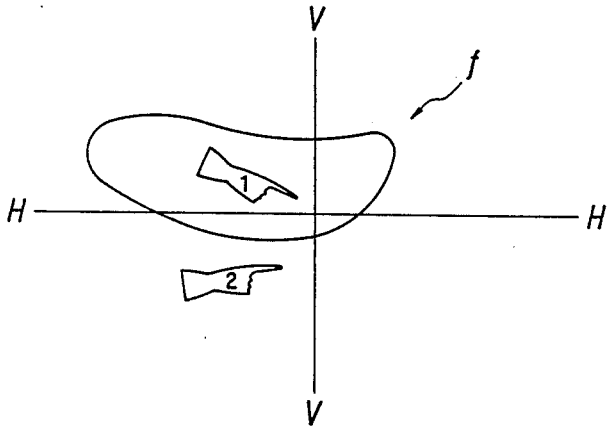
FIG. 11A PRIOR ART
FIGS. 11A and 11B are respective illustrations of high and low beam patterns provided by the conventional headlamp.
Figure 11B:
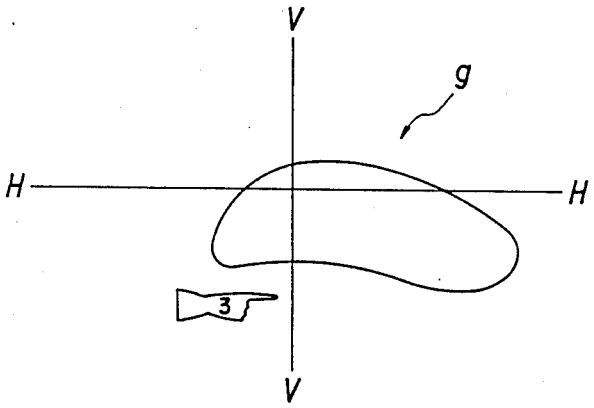
FIG. 11B PRIOR ART

When the filament 21 for the low beam is energized to produce a light, the headlamp 18 projects a light beam which has such a contoured beam pattern 28 as shown in FIG. 8B. It is to be noted that the upper illuminated part 29 is the part provided by light rays which have been reflected by the upper light reflecting surface 3, while, the lower illuminated part 30 is the part provided by light rays which have been reflected by the lower light reflecting surface 4.

As is understood from FIG. 8B, since the lower illuminated part 30 is positioned below the horizontal line "H-H" at a considerable distance from the same, the neighbouring illuminating ability of the headlamp 18 is improved.

What is claimed is:

1. A vehicular headlamp comprising:

a concave light reflector whose opening is shaped generally rectangular, said concave light reflector including upper and lower light reflecting surfaces each being of a paraboloid of revolution, said upper and lower light reflecting surfaces having respective upper and lower rotation axes which extend forward in parallel with each other and having respective focuses which are placed on said axes, said respective focuses being located at respective positions where an imaginary line perpendicular to both the rotation axes intersects the same, said focus of said lower light reflecting surface being located above a horizontal plane which defines a conjunction portion between said upper and lower light reflecting surfaces;

a lens positioned in front of said concave light reflector;

a first light source positioned at the focus of said lower light reflecting surface; and a second light source positioned just above the focus of said upper light reflecting surface.

2. A vehicular headlamp as claimed in claim 1, in which said upper light reflecting surface is larger than said lower light reflecting surface.

3. A vehicular headlamp as claimed in claim 2, in which said upper light reflecting surface occupies about 50 to 75 percent of the entire light reflecting area of said concave light reflector.

4. A vehicular headlamp as claimed in claim 3, in which each of said first and second light sources is a coiled filament of an electric bulb, said electric bulb being held by said concave light reflector.

5. A vehicular headlamp as claimed in claim 3, in which each coiled filament extends in parallel with the corresponding rotation axis.

6. A vehicular headlamp as claimed in claim 3, in which each coiled filament extends horizontally in a direction perpendicular to the corresponding rotation axis.

7. A vehicular headlamp as claimed in claim 6, in which the coiled filaments are located at respective positions which are offset with respect to an imaginary plane which contains said upper and lower rotation axes.

8. A vehicular headlamp as claimed in claim 1, in which said concave light reflector has a generally rectangular opening which is closed by said lens.

9. A vehicular headlamp as claimed in claim 4, in which said electric bulb has a tip portion coated with a light blocking material.

* * * * *